US010077569B2

(12) United States Patent
Marshall et al.

(10) Patent No.: US 10,077,569 B2
(45) Date of Patent: Sep. 18, 2018

(54) SWIMMING POOL DECK JET SYSTEM AND ASSOCIATED METHODS

(71) Applicant: Hayward Industries, Inc., Elizabeth, NJ (US)

(72) Inventors: Brian D. Marshall, Aurora, IL (US); Jacob Cody Smith, Lexington, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 15/345,617

(22) Filed: Nov. 8, 2016

(65) Prior Publication Data

US 2017/0130477 A1 May 11, 2017

Related U.S. Application Data

(60) Provisional application No. 62/252,829, filed on Nov. 9, 2015.

(51) Int. Cl.
*E04H 4/00* (2006.01)
*E04H 4/14* (2006.01)
*B05B 15/652* (2018.01)

(52) U.S. Cl.
CPC ..... *E04H 4/14* (2013.01); *B05B 15/652* (2018.02); *E04H 4/0075* (2013.01)

(58) Field of Classification Search
CPC ..... E04H 4/14
USPC ..... 4/492, 541.1–541.6
See application file for complete search history.

(56) References Cited

U.S. PATENT DOCUMENTS

| | | | | |
|---|---|---|---|---|
| 4,985,943 | A | 1/1991 | Tobias et al. | |
| 8,366,016 | B2 | 2/2013 | Simpson | |
| 2007/0289056 | A1* | 12/2007 | Reynoso | A61H 33/027 4/541.6 |
| 2014/0246513 | A1 | 9/2014 | Terrell | |

OTHER PUBLICATIONS

International Search Report dated Mar. 16, 2017, issued in connection with International Application No. PCT/US2016/060896 (4 pages).
Written Opinion of the International Searching Authority dated Mar. 16, 2017, issued in connection with International Application No. PCT/US2016/060896 (7 pages).

* cited by examiner

*Primary Examiner* — Christine Skubinna
(74) *Attorney, Agent, or Firm* — McCarter & English, LLP

(57) ABSTRACT

Exemplary embodiments are directed to deck jet systems including an adjustable cover and flexible finishing cap. The deck jet systems include a housing with threads formed on an inner surface of the housing. The deck jet systems include an adjustment ring with threads formed on an outer surface of the adjustment ring complementary to the threads of the housing. The deck jet systems include an adjustable cover, the bottom surface of the adjustable cover being inserted into the proximal end of the housing and supported by a top surface of the adjustment ring. Engagement of the threads of the housing and the adjustment ring and rotation of the adjustment ring relative to the housing can vary an elevation of the adjustment ring relative to the housing which, in turn, varies an elevation of the adjustable cover relative to the housing. Exemplary embodiments are also directed to methods of adjusting a deck jet system.

13 Claims, 19 Drawing Sheets

SWIMMING POOL DECK JET SYSTEM AND ASSOCIATED METHODS

CROSS-REFERENCE TO RELATED APPLICATIONS

The present application claims the priority benefit of U.S. Provisional Application Ser. No. 62/252,829, filed Nov. 9, 2015, which is hereby incorporated by reference in its entirety.

TECHNICAL FIELD

The present disclosure relates to swimming pool water feature systems and associated methods and, in particular, to swimming pool deck jet systems including a flexible finishing cap for a more efficient installation of the deck jet system within a swimming pool deck and an adjustable cover for aligning the cover with the swimming pool deck surface.

BACKGROUND

Swimming pools generally include a variety of equipment or water features surrounding the swimming pool and disposed within a housing located in the concrete deck around the swimming pool. The equipment or water features typically include a housing located below the top surface of the concrete deck and a rigid cover that fits over the housing to at least partially enclose the equipment or water features.

In general, during installation of the concrete deck the rigid cover or a gunite shield is placed over the housing and covered with a protective material, such as tape or a label, to prevent the rigid cover or the gunite shield from damage or dirt. During pouring of the concrete, water mixed with small amounts of concrete can leak past the rigid cover and into the housing, requiring the installer to chip out the dried concrete from the housing after the concrete has set. During setting of the concrete, the concrete can stick to the rigid cover and results in chipping or cracking of the concrete when the rigid cover is removed. The rigid cover can also be damaged during removal of the rigid cover after the concrete has set. In some installations, domed flexible covers are used that do not allow for finishing of the concrete to the desired height. Additional resources are needed to repair the concrete within the housing, the chipped or cracked areas of the concrete, the rigid cover and/or the lower concrete height, thereby increasing the time and costs associated with installation of the housing.

In addition, the preferred installation of the rigid cover onto the housing results in the top of the rigid cover being flush with the surrounding surface of the concrete or stone paver material. However, the height of the traditional rigid cover is not adjustable relative to the surrounding surfaces. In some instances, as shown in FIGS. 1 and 2, the concrete or stone paver material 10 surrounding the rigid cover 12 can settle over time, resulting in the top 14 of the rigid cover 12 sinking below or protruding over the surrounding surface of the concrete or stone paver material 10. The effect of settling of the concrete or stone paver material 10 on the rigid cover 12 increases a tripping hazard for those around the swimming pool.

Thus, a need exists for swimming pool deck jet systems with finishing caps to ensure a water-tight seal during installation of the concrete, removal of the finishing caps without chipping or cracking the surrounding concrete, and installation of the concrete to the desired height level. A need further exists for swimming pool deck jet systems with covers for a housing with an adjustable height to allow for adjustment of the cover relative to the surrounding surfaces. These and other needs are addressed by the swimming pool deck jet systems and associated methods of the present disclosure.

SUMMARY

In accordance with embodiments of the present disclosure, exemplary housing or deck jet systems that include a housing and an adjustment ring are provided. The housing includes an inner surface, an outer surface, a proximal end and a distal end. The inner surface of the housing can include threads formed thereon. The threads can be spaced from the proximal end. The adjustment ring can include an inner surface, an outer surface and a top surface. The outer surface of the adjustment ring can include threads formed thereon complementary to the threads of the housing. The housing systems can include an adjustable cover including a top surface and a bottom surface. The bottom surface of the adjustable cover can be inserted into the proximal end of the housing with the bottom surface of the adjustable cover being supported by the top surface of the adjustment ring. Engagement of the threads of the housing and the adjustment ring and rotation of the adjustment ring relative to the housing can vary an elevation (e.g., a vertical position) of the adjustment ring relative to or within the housing. Variation of the elevation (e.g., a vertical position) of the adjustment ring relative to the housing can vary an elevation (e.g., a vertical position) of the adjustable cover relative to the housing. References herein to the term "vertical position" are understood to additionally include a reference to "elevation" and vice versa. Furthermore, references to elevation, for example, are not limited to a reference direction that is perfectly vertical, but such reference contemplates embodiments where the direction has a vertical component and a horizontal component, wherein at least one component is of a magnitude greater than zero.

In some embodiments, the housing can be configured to be installed within a concrete or composite material deck surrounding a swimming pool. Variation of the elevation of the adjustable cover relative to the housing can align the top surface of the adjustable cover with surrounding surfaces of the concrete or composite material deck.

The adjustment ring can include a plurality of protrusions circumferentially formed on and extending (e.g., inwardly) from the inner surface of the adjustment ring. The plurality of protrusions can provide a gripping surface for rotation of the adjustment ring relative to the housing. In some embodiments, one of the plurality of protrusions can provide a visual marker indicating a rotational position of the adjustment ring relative to the housing. In some embodiments, the visual marker can be one of the protrusions being shaped in the form of an arrow. Rotation of the adjustment ring relative to the housing can incrementally vary the elevation of the adjustment ring relative to the housing. In particular, rotation of the adjustment ring relative to the housing can incrementally vary the elevation of the adjustment ring relative to the proximal end of the housing.

In accordance with embodiments of the present disclosure, exemplary methods of adjusting a housing or deck jet system are provided that include providing a housing system as described herein. The methods include engaging the threads of the housing and the adjustment ring, and rotating the adjustment ring relative to the housing to vary an elevation of the adjustment ring relative to the housing. The methods include inserting the bottom surface of the adjustable cover into the proximal end of the housing with the bottom surface of the adjustable cover being supported by the top surface of the adjustment ring. Variation of the elevation of the adjustment ring relative to the housing can vary an elevation of the adjustable cover relative to the housing. In some embodiments, the methods can include installing the housing within a concrete deck. The methods can include varying the elevation of the adjustable cover relative to the housing by rotating the adjustment ring relative to the housing to substantially align the top surface of the adjustable cover with surrounding surfaces of the concrete deck.

In accordance with embodiments of the present disclosure, exemplary housing or deck jet systems are provided that include a housing and a flexible finishing cap. Embodiments of the flexible finishing cap are particularly advantageous during the process of installing the housing in concrete, for example. The housing includes a proximal end, a distal end and a cavity formed within the housing. The flexible finishing cap can be configured and dimensioned to mate with the proximal end of the housing to seal the cavity of the housing from the proximal end. The flexible finishing cap can create a fluid-tight seal between the flexible finishing cap and the proximal end of the housing. In some embodiments, the flexible finishing cap can be press fit into the proximal end of the housing and the friction between the flexible finishing cap and the housing creates the fluid-tight seal.

The flexible finishing cap can include a proximal portion with a diameter dimensioned greater than a diameter of a distal portion of the flexible finishing cap. The distal portion can be configured and dimensioned to mate with the proximal end of the housing to seal the cavity of the housing from the proximal end. The flexible finishing cap can include a circumferential step between the proximal portion and the distal portion. The circumferential step of the flexible finishing cap can be configured to abut a top edge of the proximal end of the housing. In some embodiments, the flexible finishing cap can include a plurality of protrusions at a top surface for disengaging the flexible finishing cap from the housing.

In accordance with embodiments of the present disclosure, exemplary methods of installation of a housing or deck jet system are provided that include providing a housing system as described herein. The methods include mating the flexible finishing cap with the proximal end of the housing to seal the cavity of the housing from the proximal end. The methods include pouring a composite material (e.g., concrete) around the housing and the flexible finishing cap up to a top surface of the flexible finishing cap. The methods include removing the flexible finishing cap from the proximal end of the housing to expose an opening in the composite material about the housing. The opening can define a substantially sharp and clean edge without cracking and chipping of the composite material.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed swimming pool deck jet systems and associated methods, reference is made to the accompanying figures, wherein.

DESCRIPTION OF EXEMPLARY EMBODIMENTS

In accordance with embodiments of the present disclosure, exemplary swimming pool deck jet systems are provided that include a finishing cap for installation of the surrounding concrete deck. The finishing cap creates a water-tight seal over the housing during installation of the concrete deck, thereby preventing the concrete mixture from entering the housing. The finishing cap can be formed from a flexible yet durable material, allowing for removal from the set concrete while maintaining a clean and crack- or chip-free concrete perimeter over the housing. The exemplary housing systems further include a cover with a height adjustment mechanism that allows for adjustment and customization of the cover relative to the surrounding surfaces. The cover can thereby be maintained substantially flush with the surrounding surfaces, even during settling of the concrete around the housing.

Figure 3:
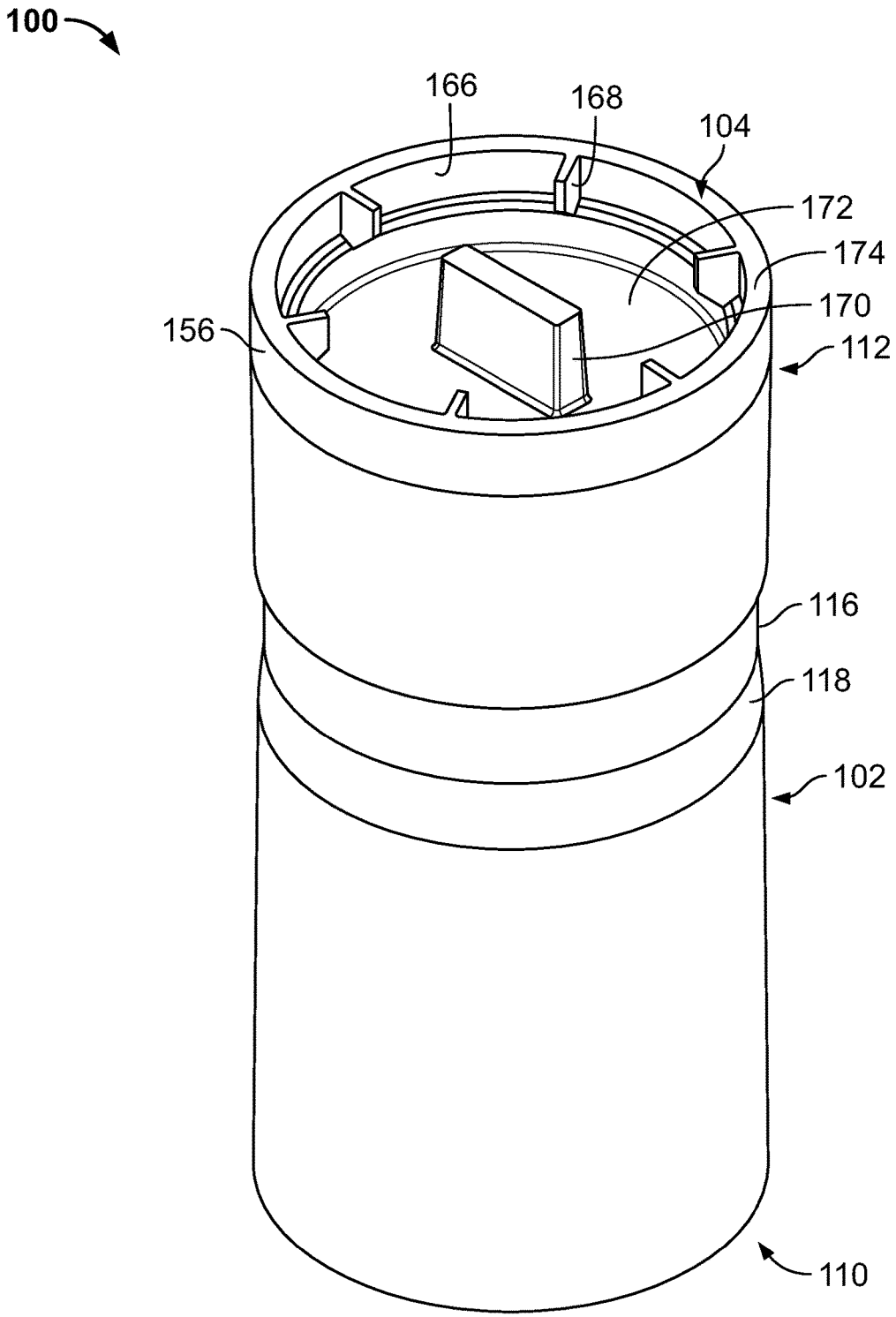
FIG. 3 is a perspective view of an exemplary swimming pool deck jet system including a finishing cap in accordance with embodiments of the present disclosure.
Figure 4:
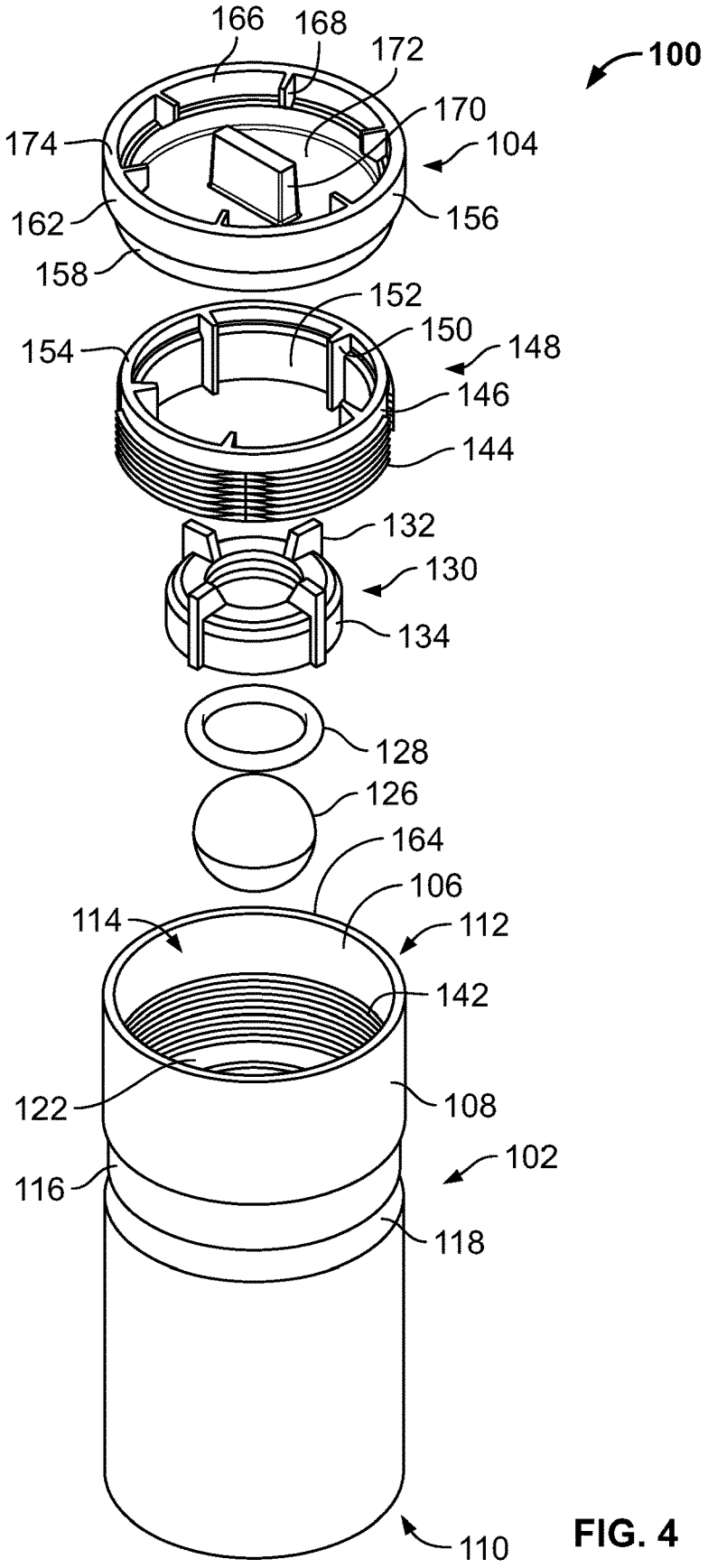
FIG. 4 is an exploded, perspective view of an exemplary swimming pool deck jet system of FIG. 3.
Figure 5:
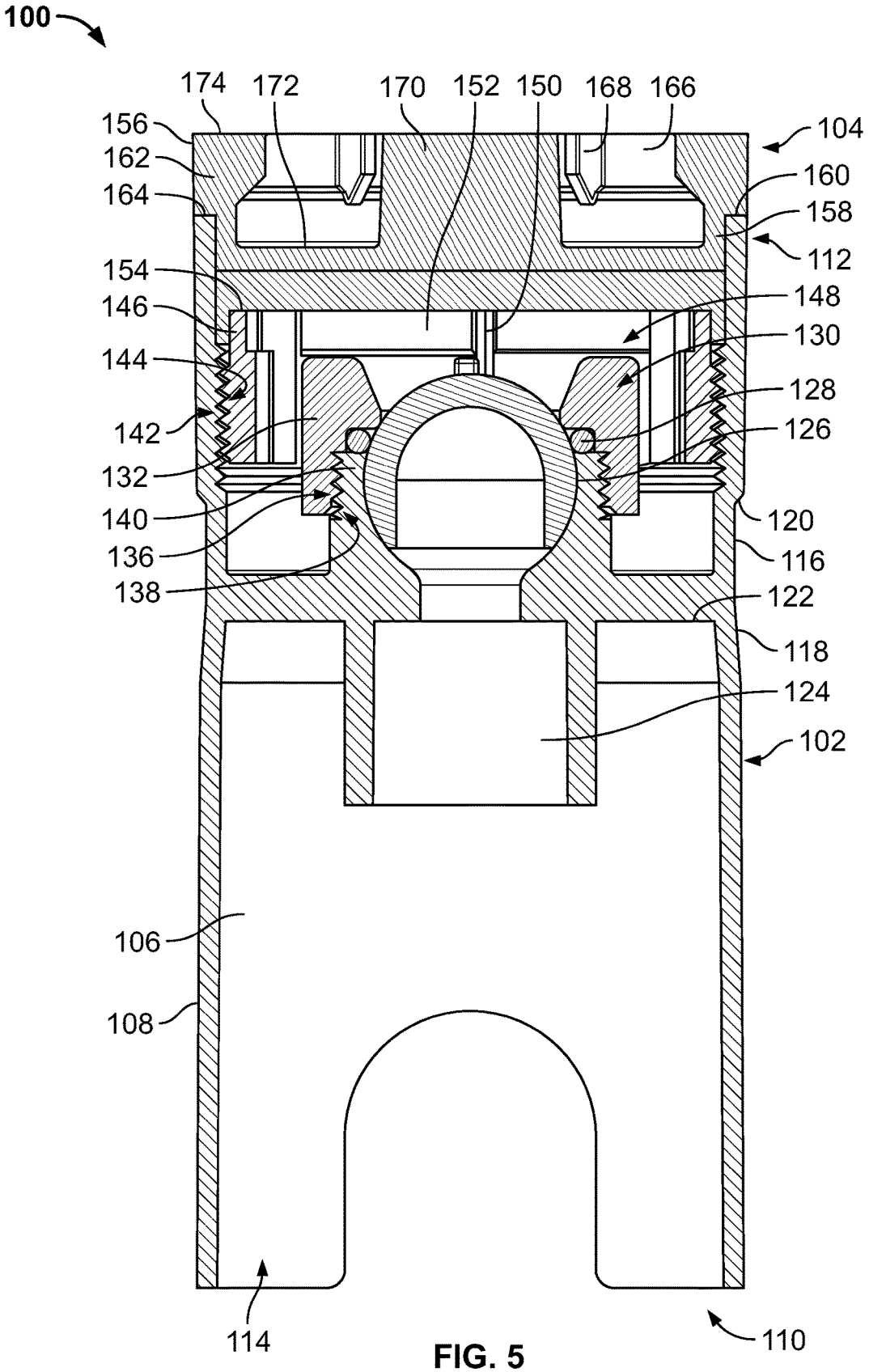
FIG. 5 is a cross-sectional view of an exemplary swimming pool deck jet system of FIG. 3.

With reference to FIGS. 3-5, perspective, exploded and cross-sectional views of an exemplary swimming pool deck jet system 100 (hereinafter "system 100") are provided. Although discussed herein with respect to a system 100 for a water feature including a nozzle jet, it should be understood that the system 100 can be implemented for a variety of equipment or water features in a swimming pool environment.

The system 100 can include a housing 102 and a finishing cap 104. The housing 102 can be fabricated from a variety of materials, such as, e.g., polyvinyl chloride (PVC), or the like. The housing 102 can define a substantially tubular and cylindrical shape including an inner surface 106 and an outer surface 108. The distal end 110 (e.g., a bottom end) of the housing 102 can be configured and dimensioned to connect to plumbing piping and/or electrical wiring, and the proximal end 112 (e.g., a top end) of the housing 102 can be configured and dimensioned to receive components of a water fixture or alternative swimming pool equipment to be encased within the housing 102. In particular, the housing 102 includes an opening or cavity 114 within the walls of the inner surface 106 configured and dimensioned to receive components of the water fixture or alternative swimming pool equipment.

The housing 102 can define a substantially similar diameter at the outer surface 108 along the height of the housing 102 between the distal and proximal ends 110, 112, and includes a central section 116 defining a diameter dimensioned smaller than the remaining diameter of the housing 102. The housing 102 can include tapered surfaces 118, 120 or edges leading to the central section 116.

In some embodiments, the housing 102 can include a support or platform 122 formed within the cavity 114. The platform 122 can be used to support one or more components to be disposed within the housing 102. In some embodiments, the housing 102 can include a fluid connection 124 (e.g., a tubular pipe) centrally formed within the housing 102 for connecting a water feature with plumbing piping connected to the housing 102 at the distal end 110. As an example and as shown in FIGS. 4 and 5, the housing 102 can receive therein a seal plug 126, a seal 128 and a lock ring 130. The seal plug 126 can be substantially spherical in configuration and can be formed from a flexible material. The seal plug 126 can be positioned over the opening of the fluid connection 124 to create a water-tight seal of the fluid connection 124. The seal 128 can be in the form of a ring that can be positioned over the seal plug 126 to create a water-tight seal between the seal plug 126 and the lock ring 130.

The lock ring 130 can include protrusions or flanges 132 extending from an outer surface 134 for providing a gripping surface to a user against which force can be imparted to rotate and interlock the lock ring 130 with the housing 102. The inner surface of the lock ring 130 can include threads 136 complementary to threads 138 on a central cylindrical flange 140 extending from the fluid connection 124. The lock ring 130 can thereby be secured over the seal plug 126 and onto the housing 102 to maintain a seal of the fluid connection 124.

The housing 102 includes threads 142 formed on the inner surface 106. The threads 142 can be spaced from the proximal end 112 of the housing 102 and can be disposed between the proximal end 112 and the central section 116. The threads 142 of the housing can be configured and dimensioned to engage complementary threads 144 on an outer surface 146 of an adjustment ring 148. The adjustment ring 148 defines a diameter dimensioned smaller than the diameter of the housing 102 such that the adjustment ring 148 can be threadingly engaged with the inner threads 142 of the housing 102. The adjustment ring 148 can define a substantially cylindrical and tubular configuration.

Figure 19:
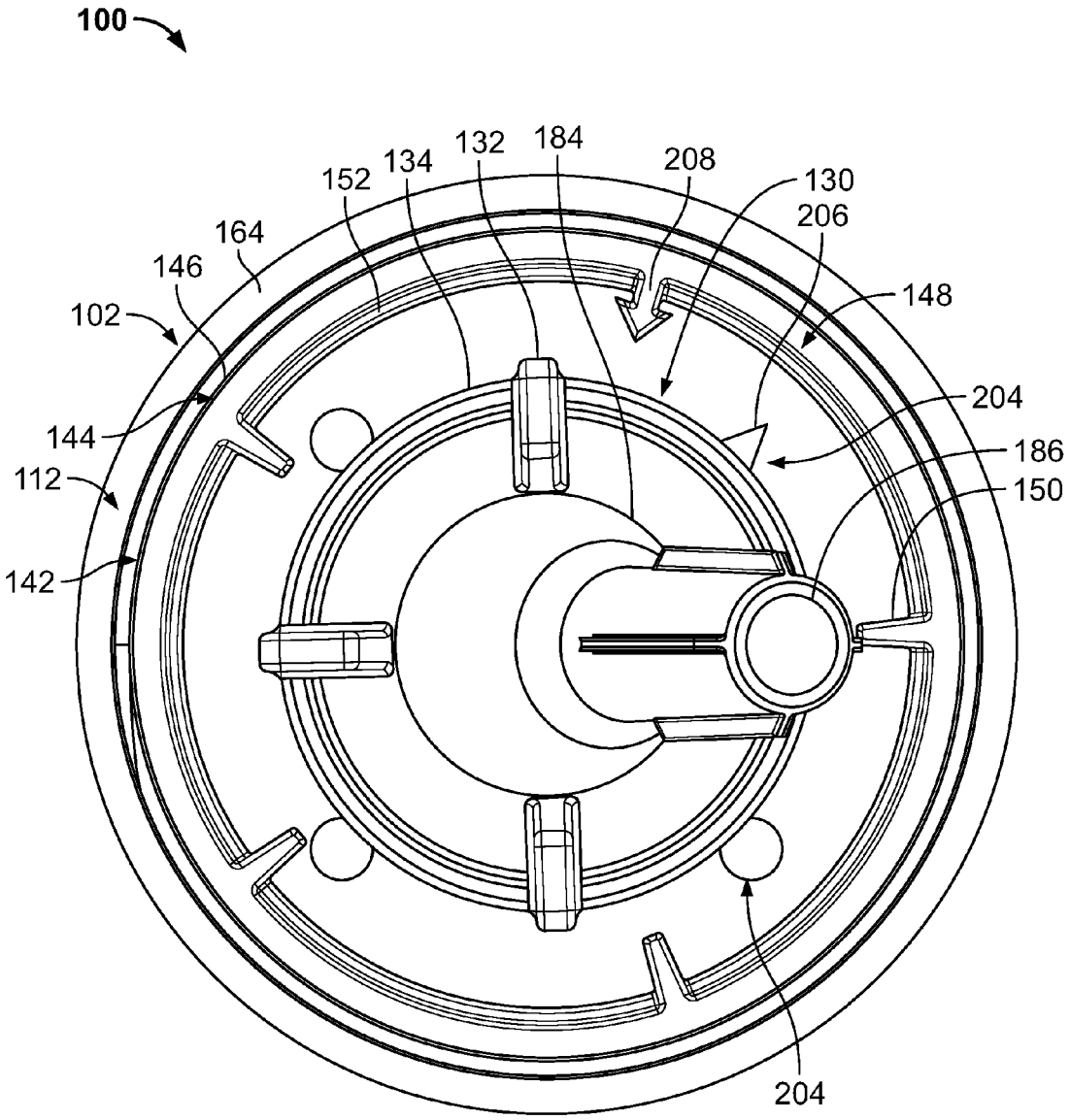
FIG. 19 is a top view of an exemplary swimming pool deck jet system of FIG. 15.
Figure 20:
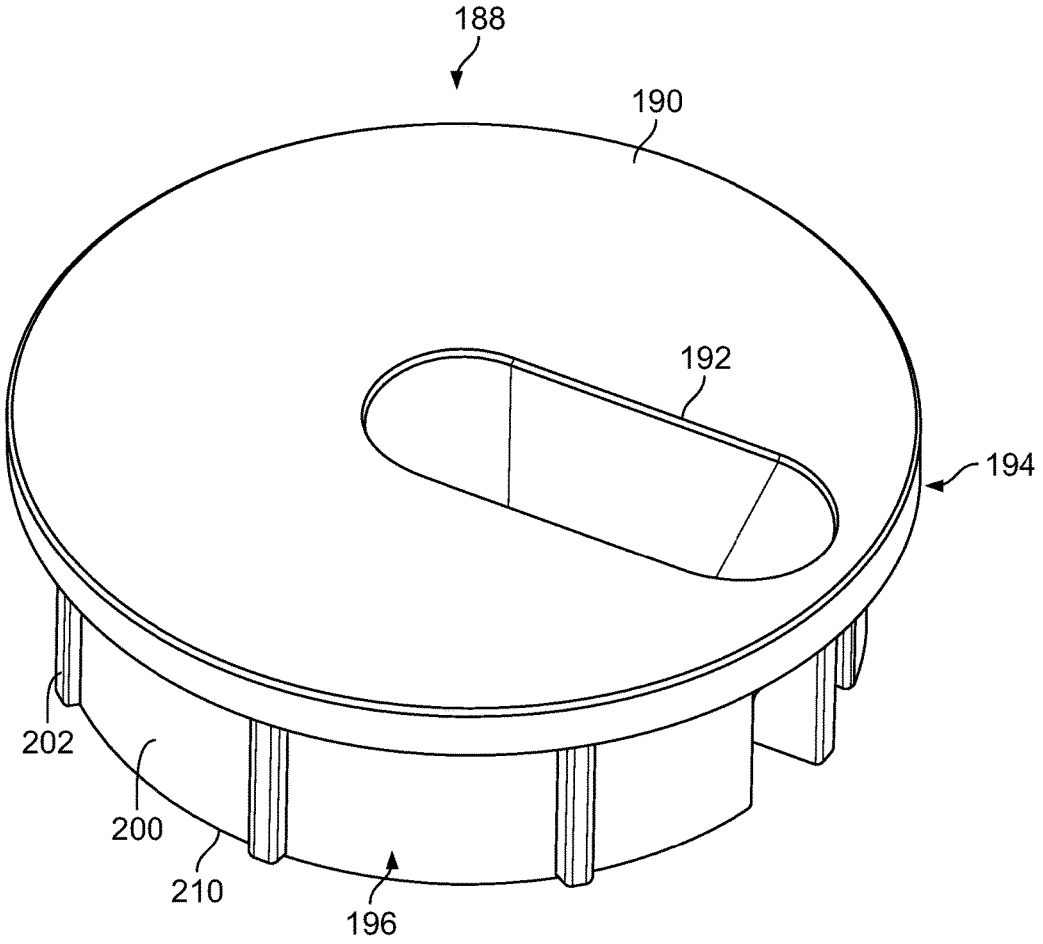
FIG. 20 is a perspective view of an adjustable cover of an exemplary swimming pool deck jet system of FIG. 15.

The adjustment ring 148 can include one or more protrusions or flanges 150 extending inwardly towards a central vertical axis from an inner surface 152. The flanges 150 can provide a surface against which pressure can be applied for rotating the adjustment ring 148 relative to the housing 102. In some embodiments, one of the flanges 150 can be in the form of an arrow (see, e.g., FIG. 19) for providing a visual orientation to the user during rotation of the adjustment ring 148. The adjustment ring 148 includes a substantially flat top surface 154 around the perimeter of the adjustment ring 148. As will be discussed in greater detail below, the top surface 154 can be configured and dimensioned to support thereon the cover of the housing 102. Similarly, the top surface 154 can support thereon the finishing cap 104. Rotating the adjustment ring 148 relative to the housing 102 adjusts the vertical height or position of the adjustment ring 148 within the housing 102, simultaneously adjusting the vertical height or position of the finishing cap 104 relative to the housing 102.

The finishing cap 104 can be substantially cylindrical in configuration and can be fabricated from a flexible yet durable material (e.g., silicone, or the like). In particular, the flexibility of the material allows the finishing cap 104 to be bent and manipulated as needed to install and remove the finishing cap 104 from the housing 102. The durability of the material allows portions of the finishing cap 104 to be gripped by tools during installation and removal of the finishing cap 104 relative to the housing 102. The material of fabrication of the finishing cap 104 also prevents or reduces the amount of concrete that sticks to the finishing cap 104 after drying.

A first or proximal portion 156 of the finishing cap 104 can be dimensioned to define a greater diameter than a second or distal portion 158 of the finishing cap 104. The difference in diameters results in a circumferential step 160 formed between the proximal and distal portions 156, 158 on an outer surface 162 of the finishing cap 104. During installation, the finishing cap 104 can be press fit into the cavity 114 of the housing 102 such that the circumferential step 160 abuts and is supported by a top edge 164 of the proximal end 112 of the housing 102. In particular, the friction between the distal portion 158 and the inner surface 106 of the housing 102 ensures a fluid-tight seal between the housing 102 and the finishing cap 104. In addition, mating of the circumferential step 160 and the top edge 164 ensures a fluid-tight seal between the finishing cap 104 and the housing 102, thereby preventing concrete mixture and other debris from entering the housing 102 during installation of the concrete deck surrounding the housing 102.

The inner side surfaces 166 of the finishing cap 104 can include one or more circumferential tabs or protrusions 168 extending inwardly therefrom. In some embodiments, the finishing cap 104 can include a tab or protrusion 170 extending vertically from a bottom portion of an inner surface 172 of the finishing cap 104 between the protrusions 168. The height or extension of the protrusions 168, 170 can be substantially flush or aligned with the top planar surface 174 or edge of the finishing cap 104. The height of the finishing cap 104 and the top planar surface 174 allows for concrete to be finished to the top planar surface 174 of the finishing cap 104, resulting in concrete set to the desired height of the surrounding surfaces. In some embodiments, the thickness of the protrusion 170 can taper in the direction of the top planar surface 174, resulting in a thinner thickness at the plane aligned with the top planar surface 174 as compared to the thickness at the inner portion 172. In some embodiments, the protrusion 170 can define a substantially constant thickness along the height of the protrusion 170. The protrusions 168, 170 can be gripped by the hands of an installer or with a tool to remove the finishing cap 104 from the housing 102 after the concrete has set around the system 100.

The finishing cap 104 provides a means of finishing concrete around the system 100 in a way that results in a clean, sharp edge of the concrete above the housing 102. In particular, the material of fabrication of the finishing cap 104 prevents or reduces the amount of concrete that sticks to the finishing cap 104 after drying. The flexible nature of the finishing cap 104 allows for smoother and easier removal of the finishing cap 104 from the housing 102 after the concrete has set, thereby preventing or reducing the amount of chipping or cracking around the perimeter of the concrete above the housing 102. In particular, the finishing cap 104 acts as a mold that forms a hole or void in the concrete above the housing 102 with a clean, sharp edge and a professional, finished appearance. The finishing cap 104 further acts as a seal for the housing 102 during installation of the concrete, keeping water, the concrete mixture and/or other debris from entering the housing 102 while construction of the swimming pool is being completed.

Figure 6:
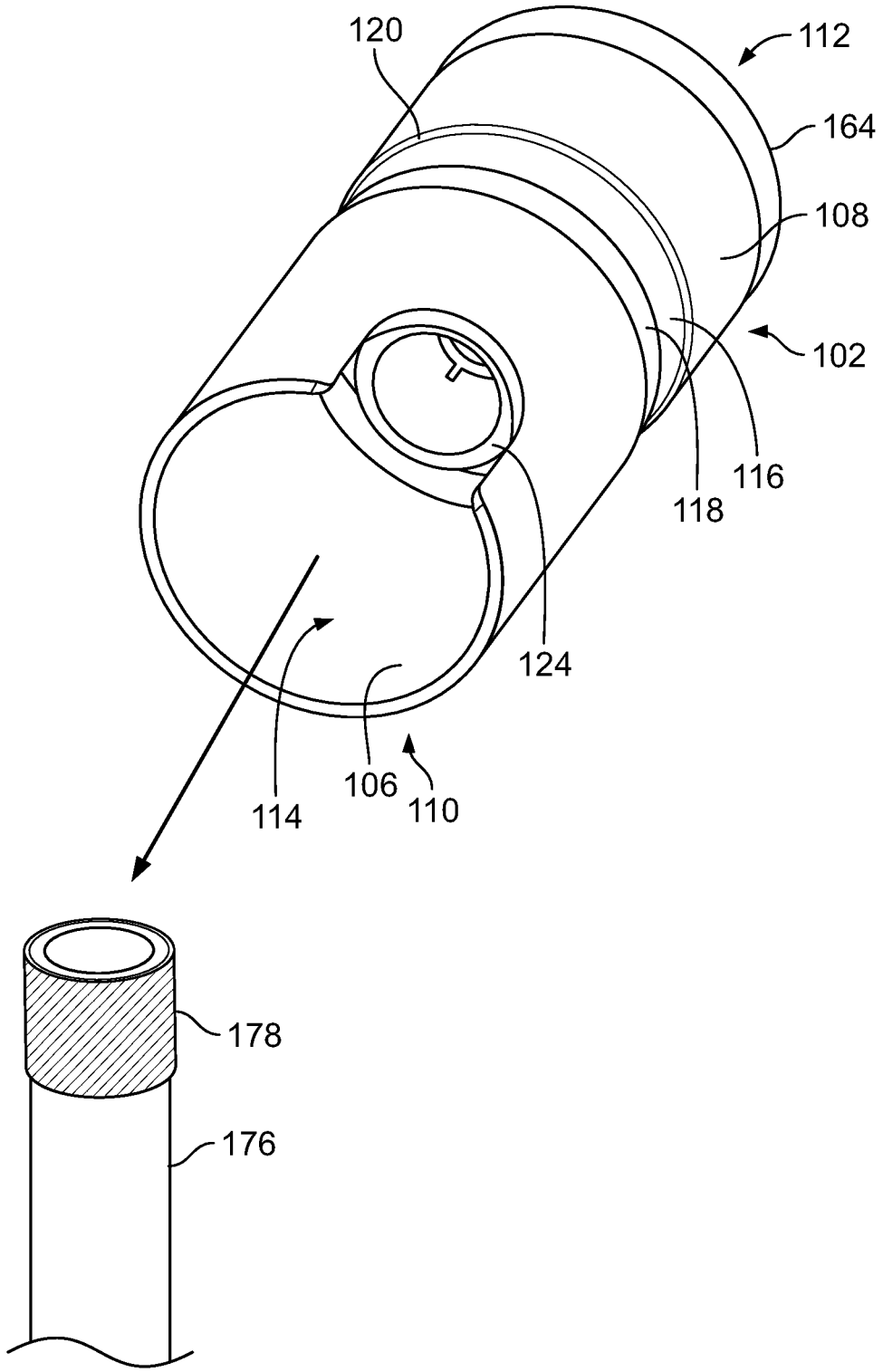
FIG. 6 is a perspective view of an installation of a housing of an exemplary swimming pool deck jet system of FIG. 3.
Figure 7:
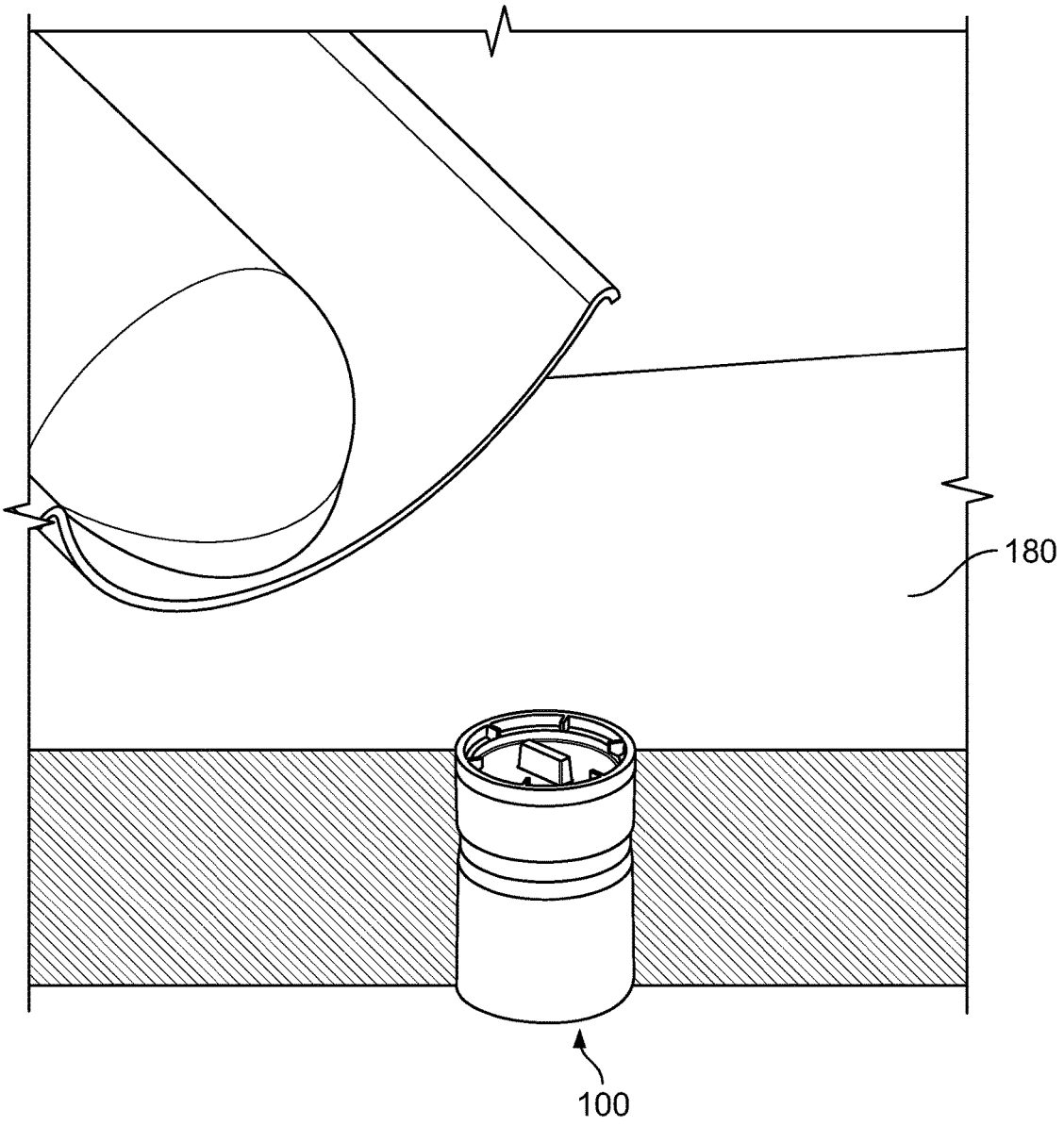
FIG. 7 is a perspective, partial cross-sectional view of an installation of an exemplary swimming pool deck jet system of FIG. 3.
Figure 8:
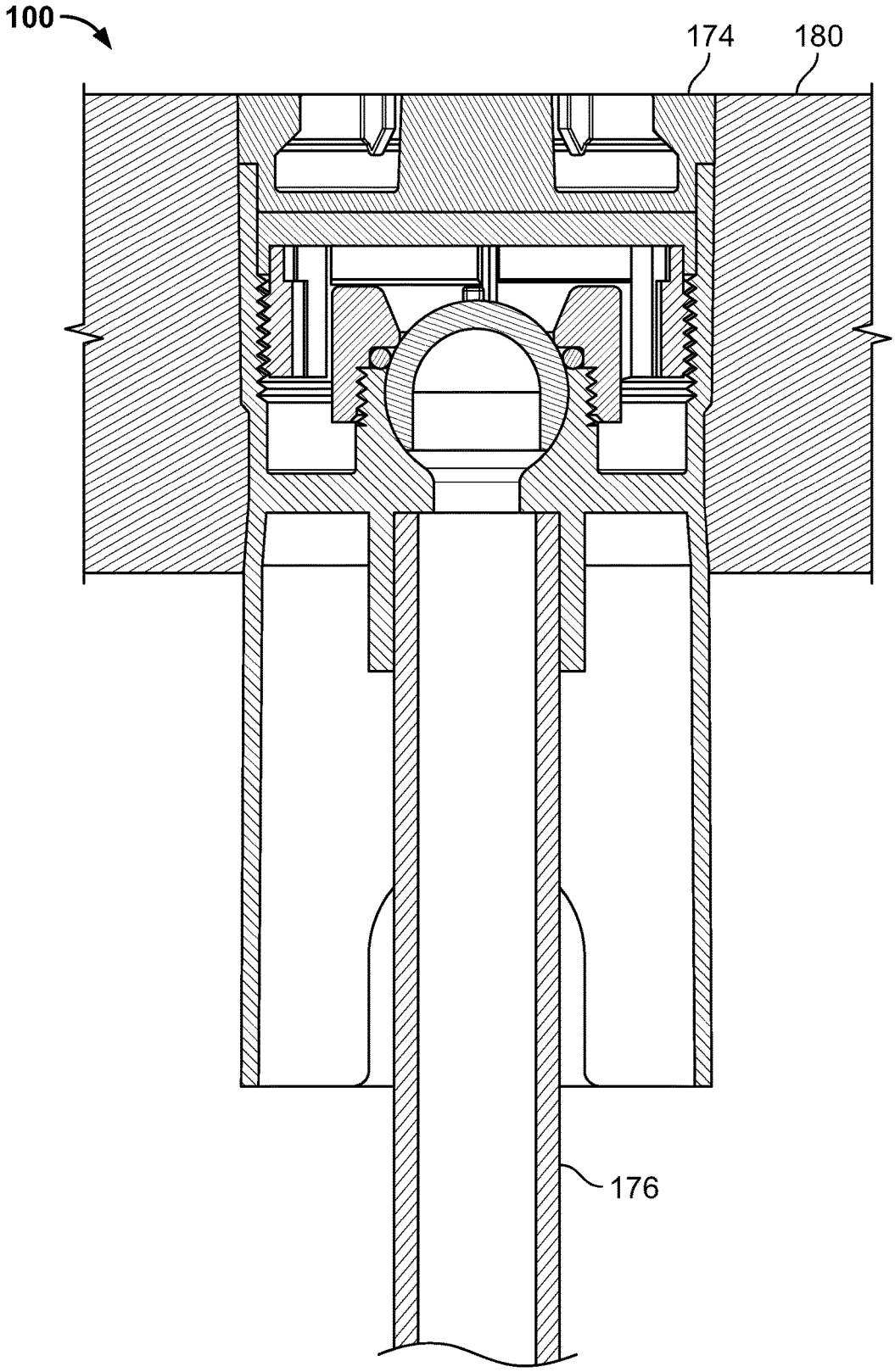
FIG. 8 is a cross-sectional view of an installation of an exemplary swimming pool deck jet system of FIG. 3.
Figure 9:
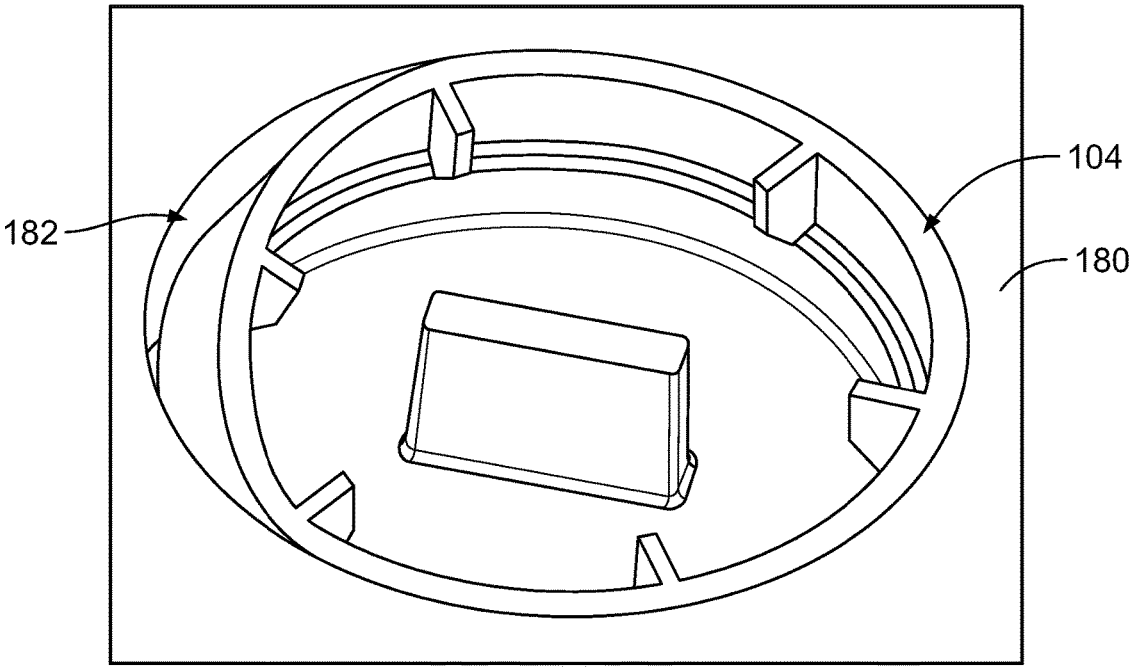
FIG. 9 is a perspective view of removal of a finishing cap of an exemplary swimming pool deck jet system of FIG. 3.
Figure 10:
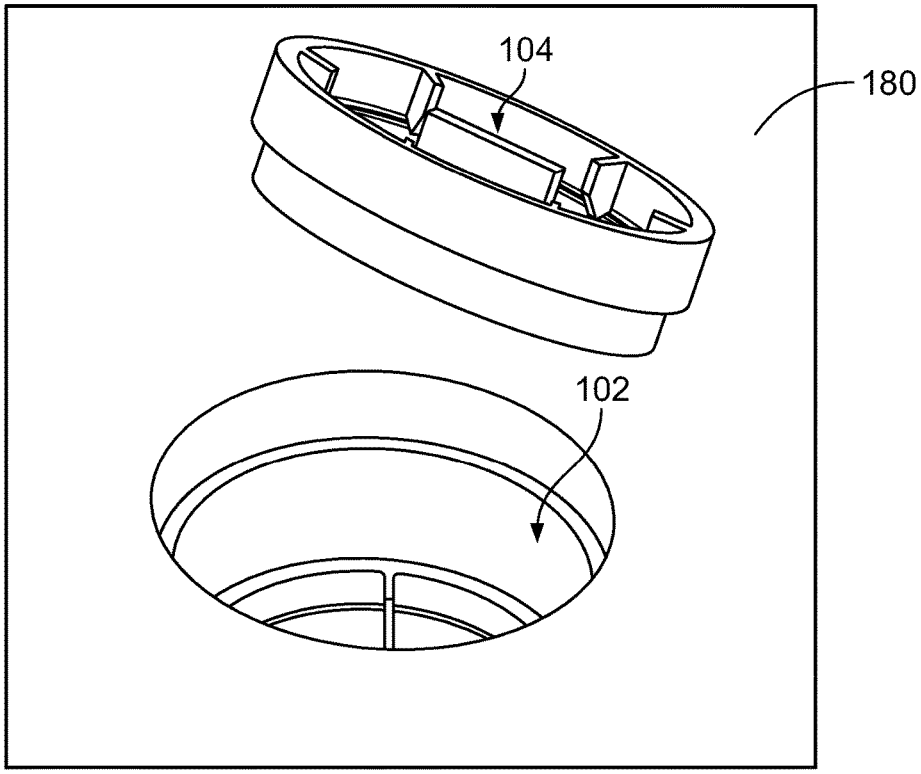
FIG. 10 is a perspective view of removal of a finishing cap of an exemplary swimming pool deck jet system of FIG. 3.
Figure 11:
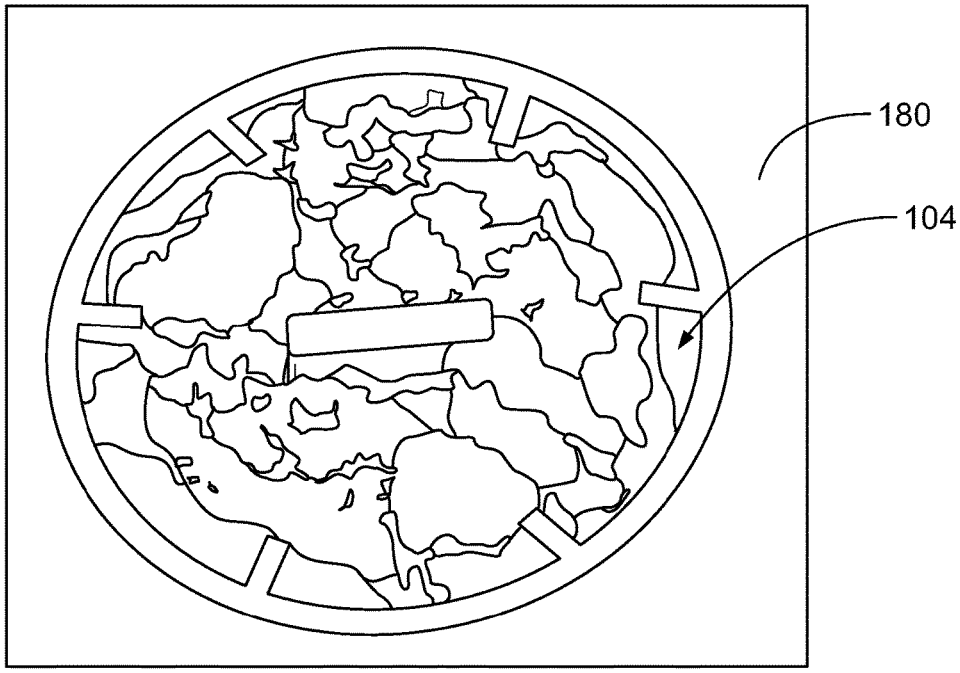
FIG. 11 is a top view of a finishing cap of an exemplary swimming pool deck jet system of FIG. 3.

FIGS. 6-12 show an exemplary installation of the system 100, including implementation of the finishing cap 104. Initially, as shown in FIG. 6, the necessary plumbing can be installed in a hole that is being prepared for a swimming pool installation. The plumbing can include one or more pipes 176. The fluid connection 124 of the housing 102 can be glued to the appropriate pipe 176 using cement 178. The seal plug 126, seal 128, lock ring 130, adjustable ring 148 and finishing cap 104 can be installed into and over the housing 102. As shown in FIGS. 7 and 8, a concrete mixture 180 can be poured around the system 100. The concrete mixture 180 can be finished up to the top planar surface 174 of the finishing cap 104. The finishing cap 104 is rigid enough to act as a mold that will form the surrounding concrete mixture 180 to the desired shape and finish, e.g., a substantially cylindrical form.

Figure 12:
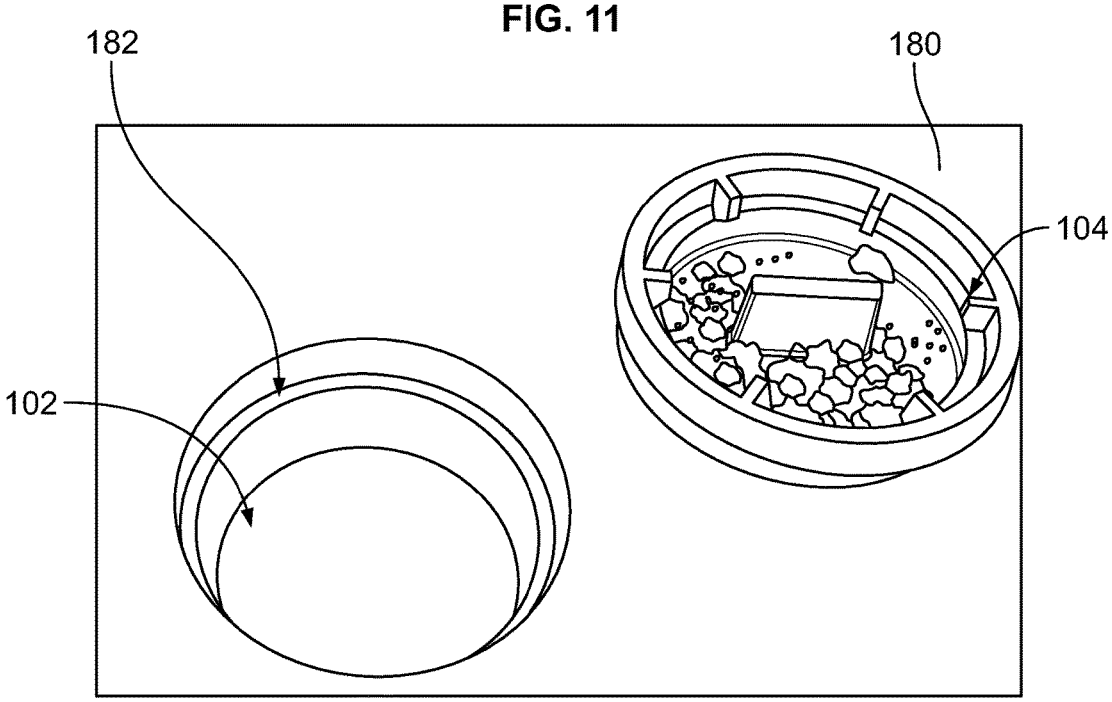
FIG. 12 is a perspective view of removal of a finishing cap of an exemplary swimming pool deck jet system of FIG. 3.

As shown in FIGS. 9-12, after the concrete mixture 180 has dried, the finishing cap 104 can be removed by pulling or peeling the finishing cap 104 away from the concrete mixture 180 using the protrusions 168, 170 on the inside diameter of the finishing cap 104 for gripping and pulling on the finishing cap 104. Although FIG. 12 shows the housing 102 without the threads 142 or the additional components of the system 100, it should be understood that such representations are provided for clarity only and that the housing 102 of FIG. 12 can include the components and features of the housing 102 of FIGS. 3-5.

The protrusions 168, 170 can be pulled by hand or using tools. The flexibility of the finishing cap 104 allows for removal of the finishing cap 104 from the concrete mixture 180 without imparting significant pressure on the surrounding concrete mixture 180. Rather than having a rigid structure that can chip or crack the surrounding concrete mixture 180, the flexible finishing cap 104 can be bent and manipulated as needed to remove the finishing cap 180 from the surrounding concrete mixture 180. Therefore, upon removal of the finishing cap 104, an opening 182 is maintained with a clean, sharp edge and a professional, finished appearance. In some embodiments, the opening 182 can be substantially conical in configuration. In some embodiments, the opening 182 can be substantially cylindrical in configuration. Preferred embodiments of the finishing cap 104 allow for the sharp edge of the opening 182 to be free of cracking or chipping concrete such as not to necessitate additional resources for restoring the opening 182 to the desired configuration. The finishing cap 104 thereby provides for a more efficient installation of the system 100 without damaging the surrounding concrete mixture 180 and allowing for the concrete mixture 180 to be installed up to the top planar surface 174 of the finishing cap 104. The finishing cap 104 can be discarded or cleaned for subsequent uses.

Figure 13:
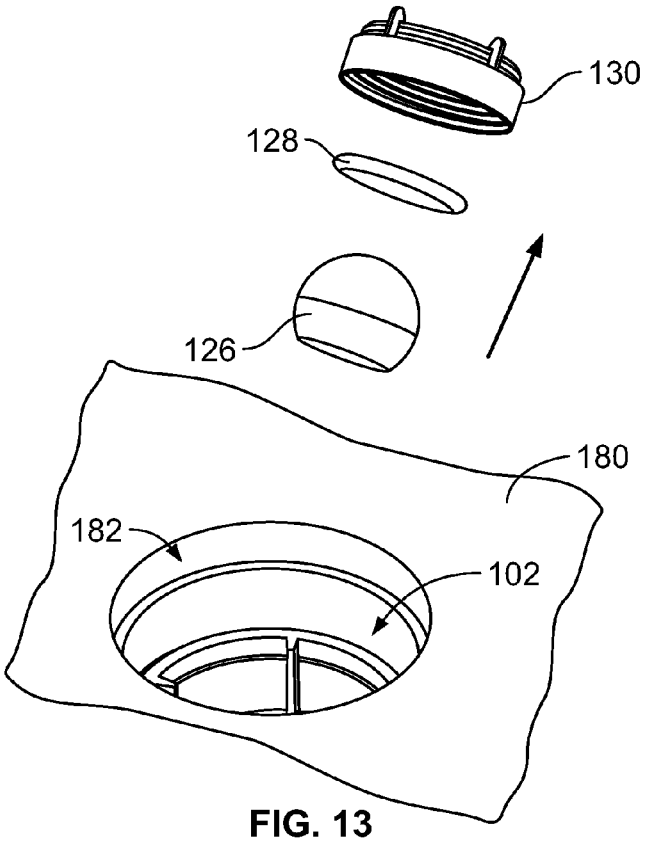
FIG. 13 is a perspective, exploded view of removal of a seal plug, seal and lock ring from an exemplary swimming pool deck jet system of FIG. 3.
Figure 14:
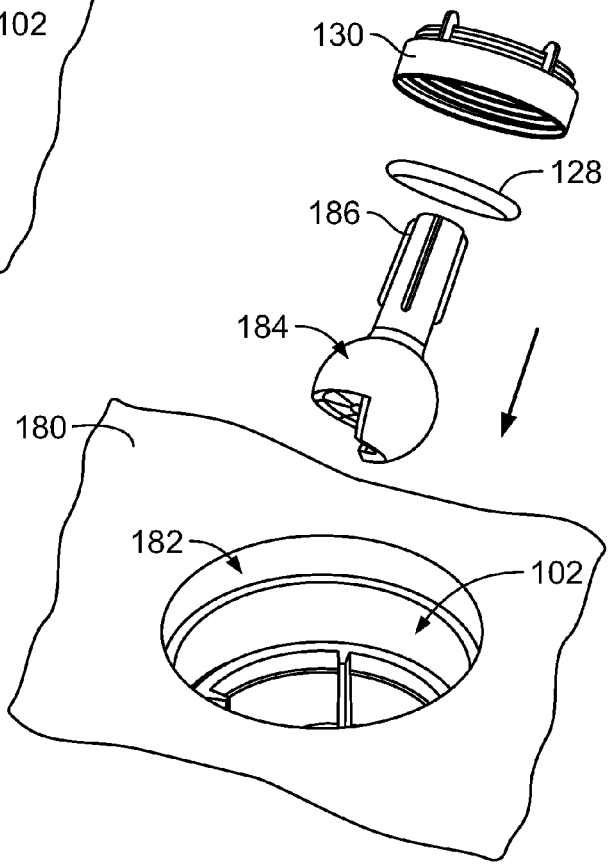
FIG. 14 is a perspective, exploded view of installation of a nozzle, seal and lock ring into an exemplary swimming pool deck jet system of FIG. 3.
Figure 15:
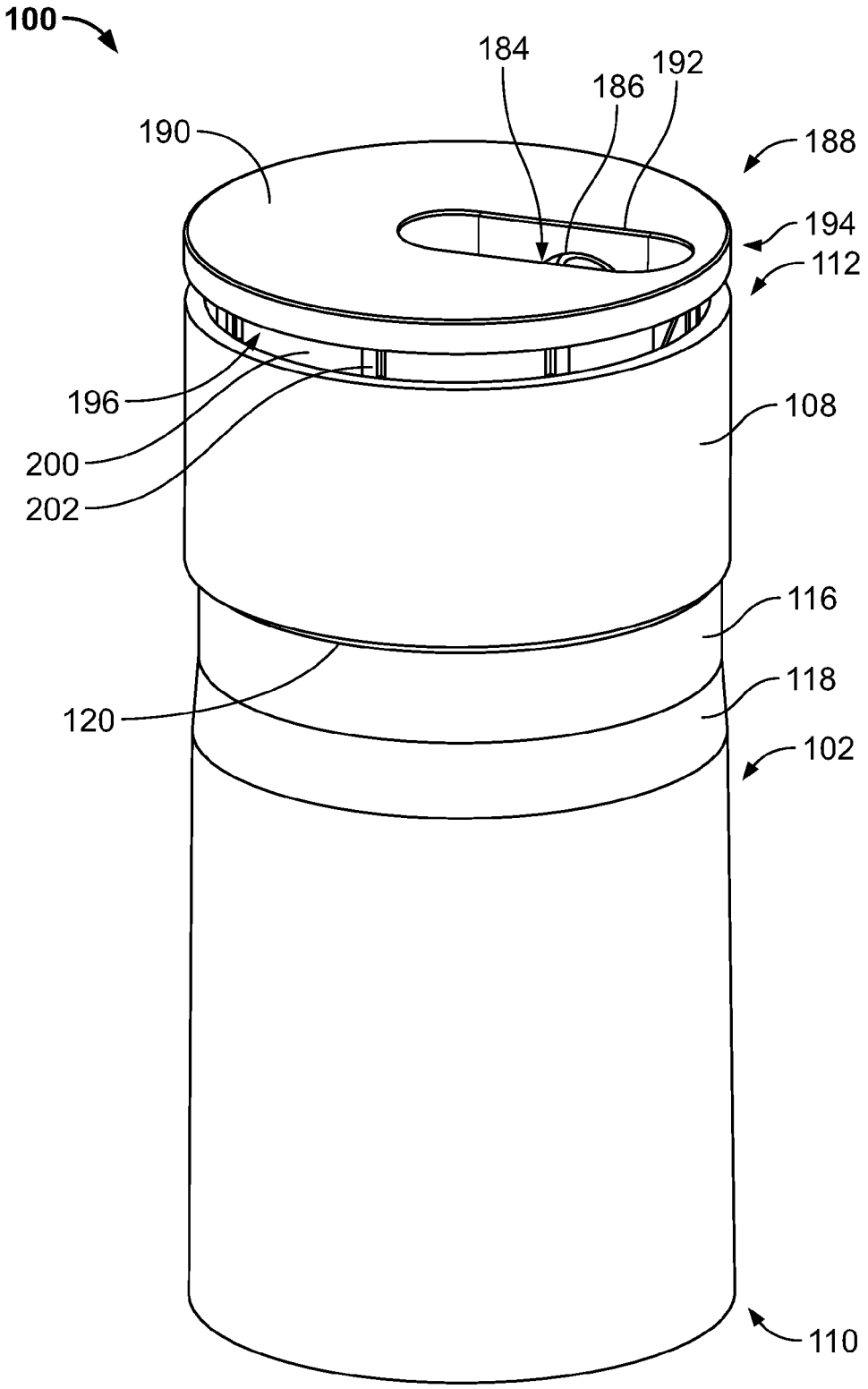
FIG. 15 is a perspective view of an exemplary swimming pool deck jet system including an adjustable cover in accordance with embodiments of the present disclosure.
Figure 16:
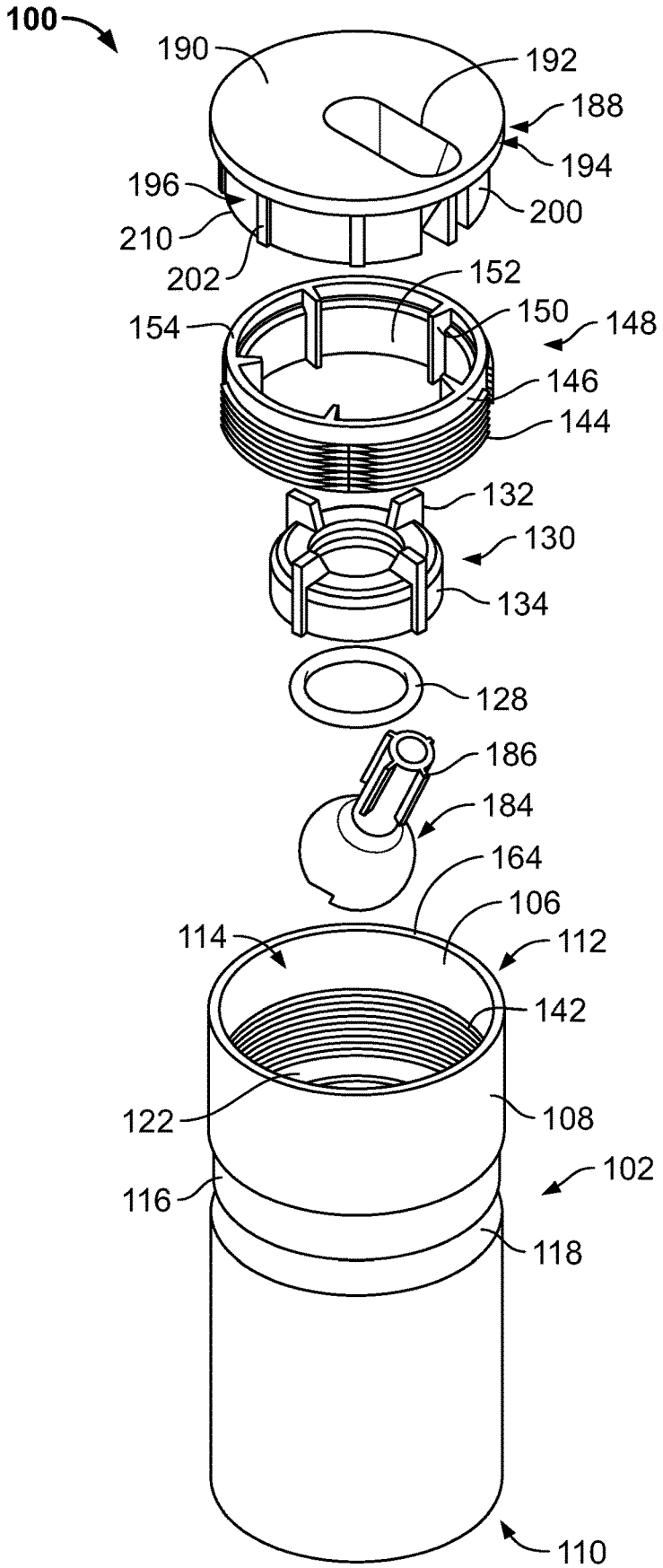
FIG. 16 is an exploded view of an exemplary swimming pool deck jet system of FIG. 15.

After the concrete mixture 180 has set and the finishing cap 104 is removed, as shown in FIG. 13, the seal plug 126, the seal 128 and the lock ring 130 can be removed from the housing 102 to prepare for installation of a water feature or alternative components within the housing 102. As shown in FIG. 14, the seal plug 126 can be replaced with a water feature 184 such that the water feature 184 is installed in a fluidic manner with the fluid connection 124 of the housing 102. In some embodiments, the water feature 184 can include a nozzle 186 for ejecting a jet of water provided through the piping 176 (see, e.g., FIG. 8). The seal 128 and the lock ring 130 can be installed over the water feature 184 to maintain a position of the water feature 184 relative to the housing 102.

FIGS. 15-20 show the exemplary system 100 including an adjustable cover 188 installed relative to the housing 102. In particular, after the finishing cap 104 has been removed and the water feature 184 is installed within the housing 102, the adjustable cover 188 can be installed onto the housing 102 such that the adjustable cover 188 rests flush or aligned with the surrounding surface of the concrete. The adjustable cover 188 can be fabricated from a variety of durable materials, e.g., PVC, or the like. The adjustable cover 188 includes a substantially flat or planar top surface 190. In some embodiments, an aperture 192 formed in the top surface 190 and passing through the adjustable cover 188. The aperture 192 can be configured and dimensioned to allow the nozzle 186 of the water feature 184 to eject a jet of fluid therethrough. In some embodiments, the top surface 190 of the adjustable cover 188 can be free of the aperture 192 and defines a continuous surface for enclosing components within the housing 102.

The adjustable cover 188 includes an upper portion 194 defining a diameter dimensioned greater than a lower portion 196 and forming a circumferential step 198 between the upper and lower portions 194, 196. The diameter of the upper portion 194 can be dimensioned substantially similar to the outer diameter of the proximal end 112 of the housing 102. The width of the circumferential step 198 can be dimensioned substantially similar to the thickness of the proximal end 164 of the housing 102. In some embodiments, the lower portion 196 of the adjustable cover 188 can be hollow or include a plurality of cavities formed therein. In some embodiments, the outer surface 200 of the lower portion 196 can include a plurality of circumferentially disposed ribs or protrusions 202. In some embodiments, the lower portion 196 can be dimensioned to be press fit within the cavity 114 of the housing 102 such that the circumferential step 198 is positioned over or abuts the top edge 164 of the housing 102. Friction between the protrusions 202 and the inner surface 106 of the housing 102 can maintain the assembly of the adjustable cover 188 with the housing 102.

As discussed above, the threads 144 of the adjustment ring 148 can be engaged with the threads 142 of the housing 102. The adjustment ring 148 can be rotated within the housing 102 to adjust the elevation of the adjustment ring 148 within the housing 102, e.g., the distance of the top surface 154 of the adjustment ring 148 from the top edge 164 of the housing 102. In some embodiments, the platform 122 can include features 204 visible through the cavity 114 when the adjustable cover 188 is removed from the housing 102 (see, e.g., FIG. 19). In some embodiments, the features 204 can be, e.g., markings on the platform 122, apertures formed through the platform 122, or the like. One of the features 204 can be in the form of an arrow 206. Similarly, one of the protrusions 150 of the adjustment ring can be in the form of an arrow 208 pointing inwardly towards the features 204. The arrows 206, 208 can provide a visual indicator to the installer regarding the angle of rotation of the adjustment ring 148 relative to the housing 102. For example, as the adjustment ring 148 is rotated relative to the housing 102, the position of the arrows 206, 208 varies to indicate the amount of rotation imparted on the adjustment ring 148. Thus, incremental and accurate adjustment of the adjustment ring 148 can be made.

Figure 17:
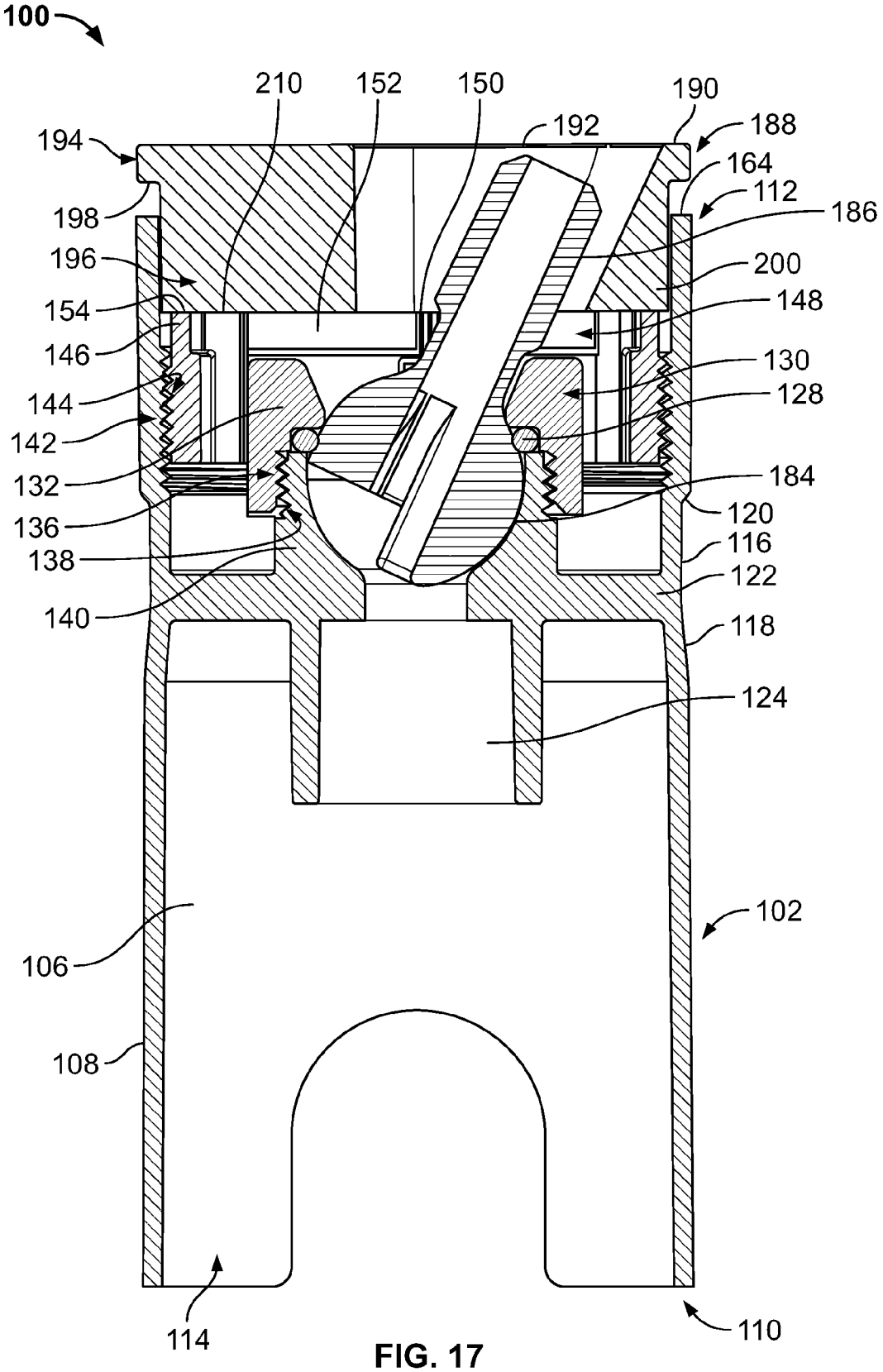
FIG. 17 is a cross-sectional view of an exemplary swimming pool deck jet system of FIG. 15.
Figure 18:
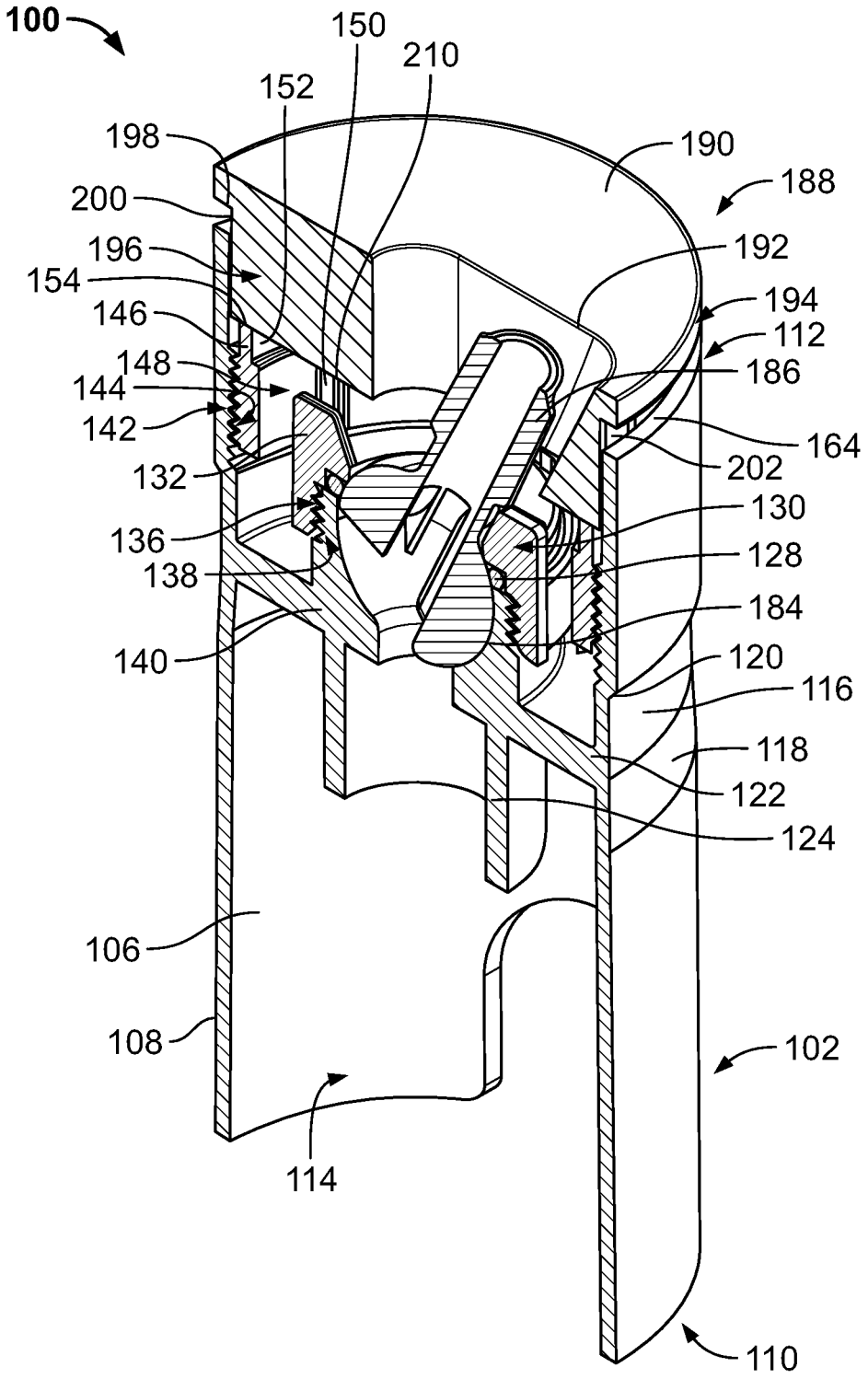
FIG. 18 is a perspective, cross-sectional view of an exemplary swimming pool deck jet system of FIG. 15.
Figure 22:
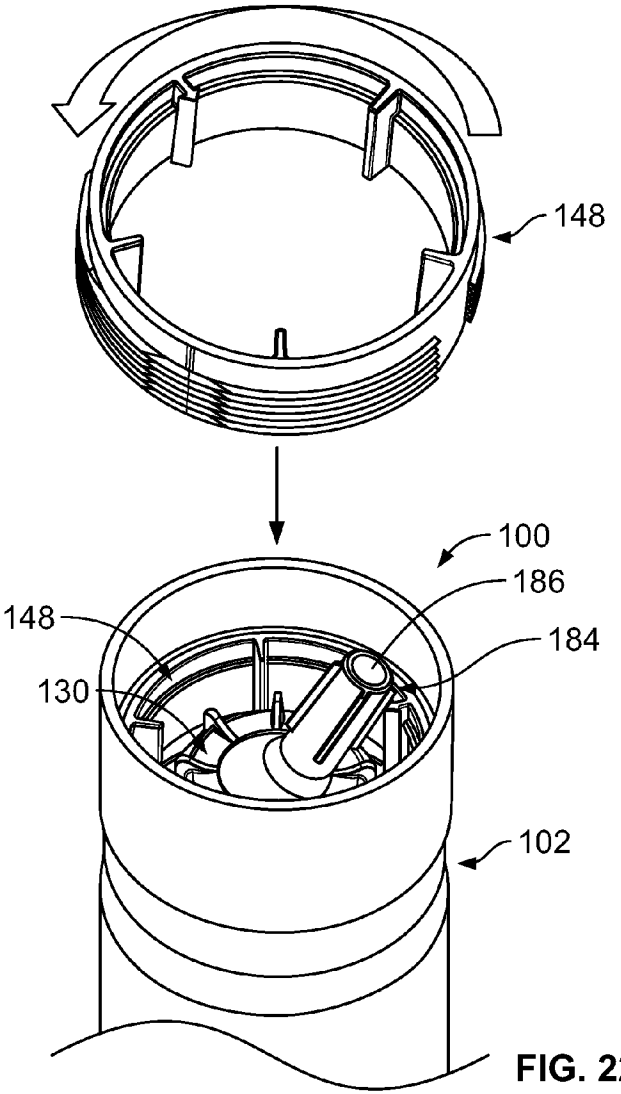
FIG. 22 is a perspective view of rotation of an adjustment ring of an exemplary swimming pool deck jet system of FIG. 15.
Figure 21:
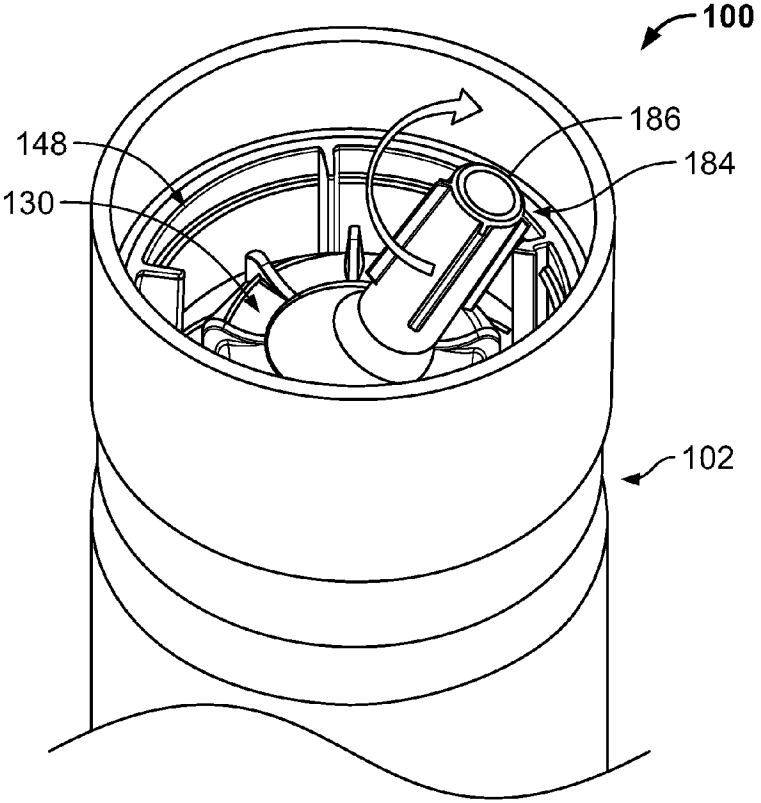
FIG. 21 is a perspective view of adjustment of a water feature of an exemplary swimming pool deck jet system of FIG. 15.

FIG. 21 shows adjustment of the water feature 184 of the system 100. In particular, prior to installation of the adjustable cover 188, the water feature 184 can be rotated or positioned as needed based on the desired angle of the ejected fluid. In some embodiments, the nozzle 186 can be rotated to adjust the flow of fluid to be ejected from the water feature 184. FIG. 22 shows a detailed view of rotation of the adjustment ring 148 for varying the elevation of the adjustment ring 148 within the housing 102. As shown in FIG. 17, the top surface 154 of the adjustment ring 148 can support thereon a bottom surface 210 of the adjustable cap 188. Thus, regulating the elevation of the adjustment ring 148 within the housing 102 simultaneously affects the elevation of the adjustable cap 188 relative to the housing 102 and the surrounding concrete surface.

Figure 1:
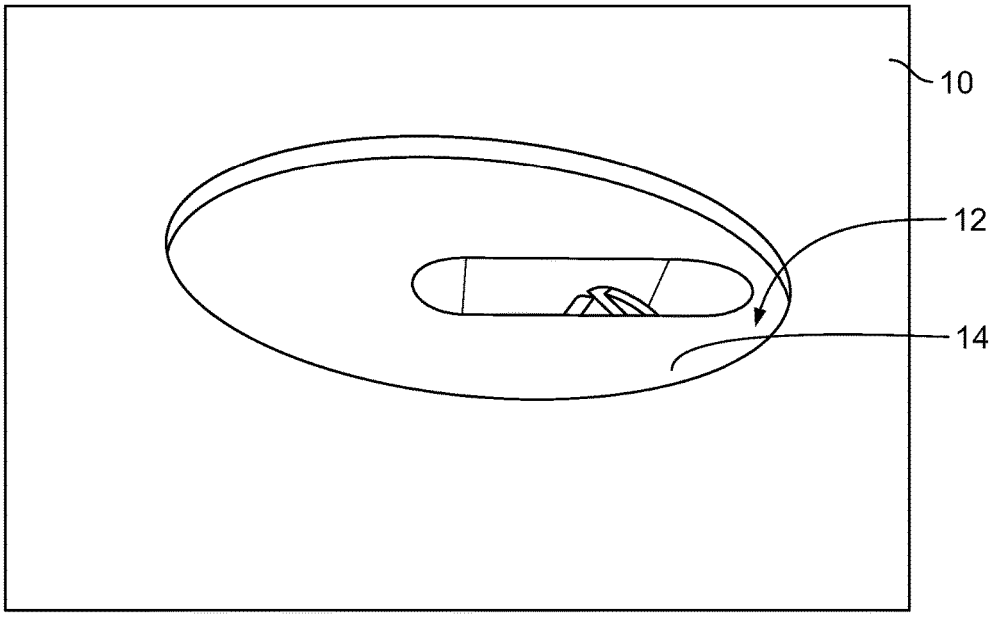
FIG. 1 (Prior Art)
FIG. 1 is a perspective view of a traditional rigid cover sinking below surrounding concrete of a swimming pool deck in accordance with the prior art.
Figure 2:
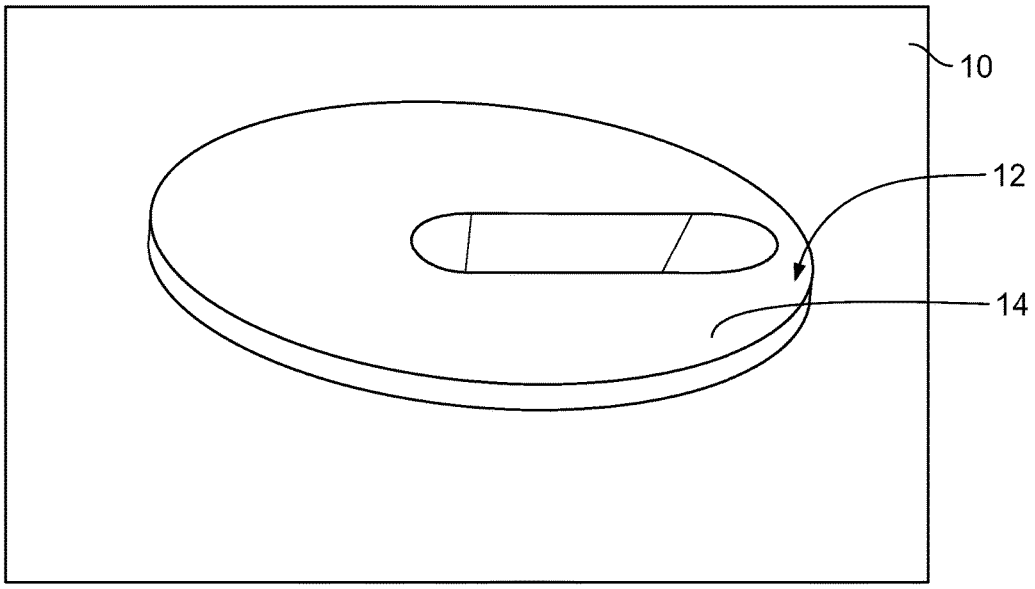
FIG. 2 (Prior Art)
FIG. 2 is a perspective view of a traditional rigid cover protruding above surrounding concrete of a swimming pool deck in accordance with the prior art.
Figure 23:
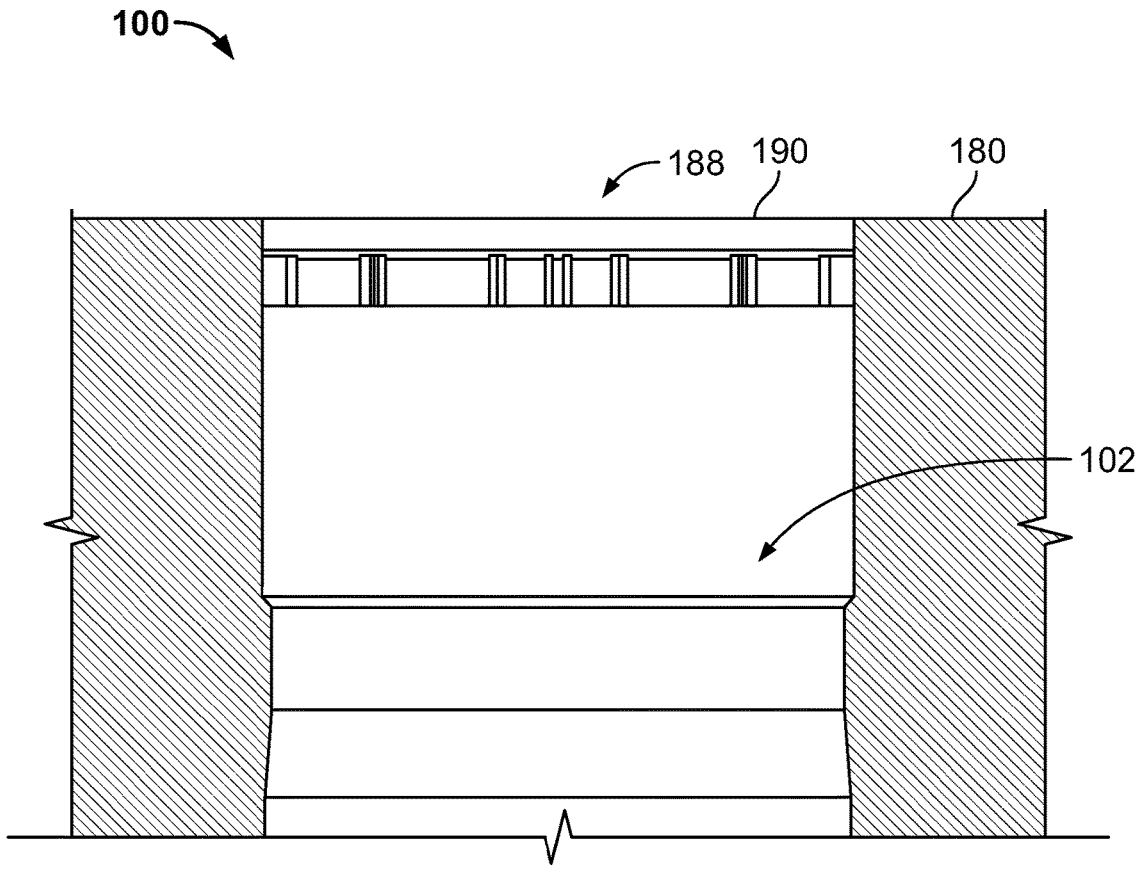
FIG. 23 is a partial cross-sectional view of an exemplary swimming pool deck jet system of FIG. 15 installed in a concrete deck.
Figure 24:
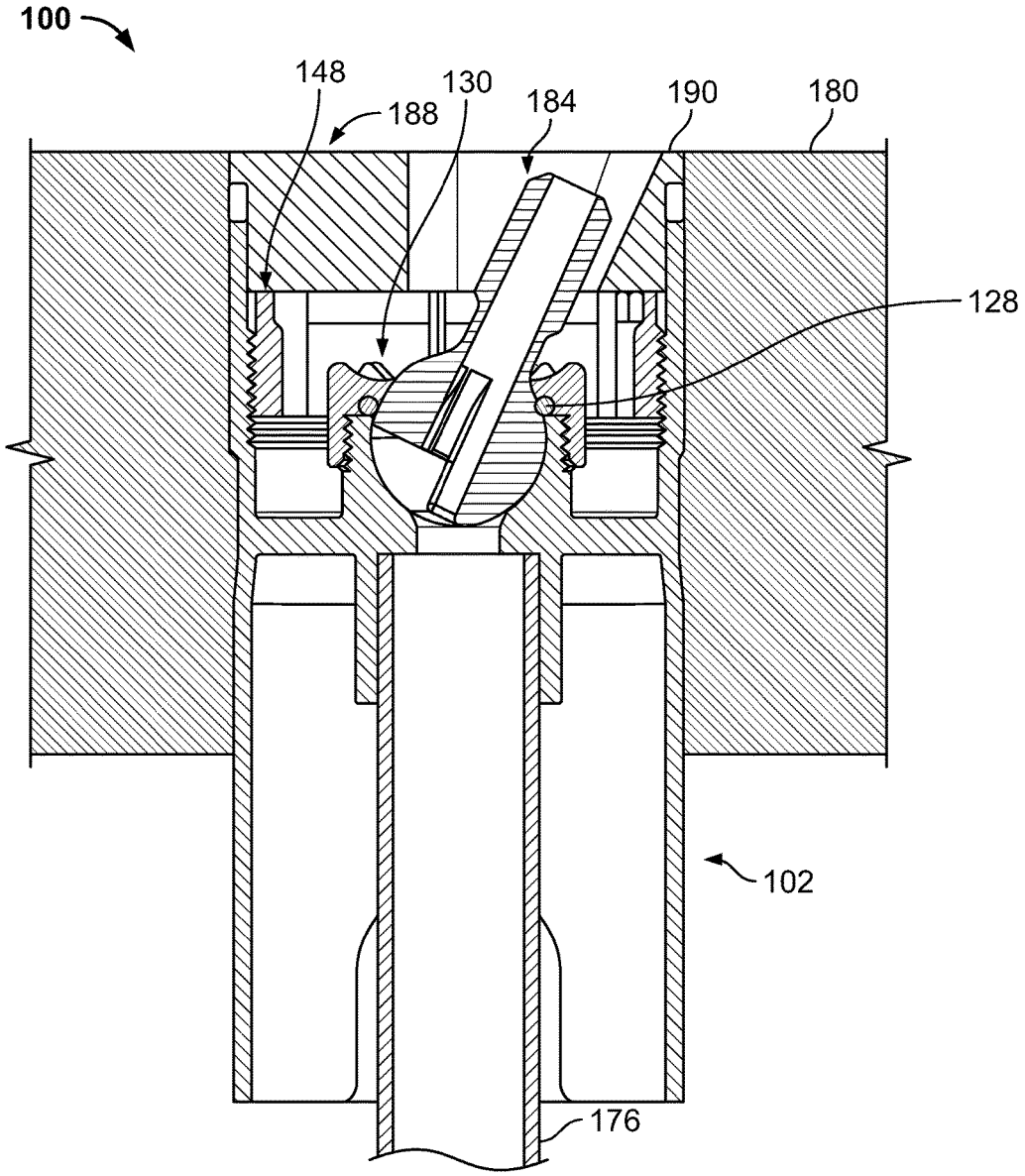
FIG. 24 is a cross-sectional view of an exemplary swimming pool deck jet system of FIG. 15 installed in a concrete deck.

FIGS. 23 and 24 show cross-sectional views of the system 100 installed within the concrete mixture 180. The elevation of the adjustment ring 148 can be regulated or customized until the top surface 190 of the adjustable cover 188 is substantially aligned with the surrounding surface of the concrete mixture 180. For example, if the top surface 190 is below the surrounding surface of the concrete mixture 180, the adjustable cover 188 can be removed from the housing 102, the adjustment ring 148 can be rotated to raise the top surface 154 of the adjustment ring 148 within the housing 102, and the adjustable cover 188 can be reinstalled at the new height (by comparison, see, e.g., FIG. 1). As a further example, if the top surface 190 is above the surrounding surface of the concrete mixture 180, the adjustable cover 188 can be removed from the housing 102, the adjustment ring 148 can be rotated to lower the top surface 154 of the adjustment ring 148 within the housing 102, and the adjustable cover 188 can be reinstalled at the new height (by comparison, see, e.g., FIG. 2).

The adjustable cover 188 can thereby be maintained flush or aligned with the surrounding concrete mixture 180 at all times and can be adjusted as needed based on changing conditions around the system 100. In particular, the adjustable cover 188 can be adjusted up or down relative to the housing 102 to prevent the tripping hazard over sunken or protruding covers, and results in an aesthetically pleasing system 100 installation.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A deck jet system, comprising:

a housing including an inner surface, an outer surface, a proximal end and a distal end, the inner surface of the housing including threads formed thereon;

an adjustment ring including an inner surface, an outer surface, and a top surface, the outer surface of the adjustment ring including threads complementary to the threads of the housing; and an adjustable cover including a top surface and a bottom surface;

wherein the bottom surface of the adjustable cover is inserted into the proximal end of the housing with the bottom surface of the adjustable cover supported by the top surface of the adjustment ring;

wherein engagement of the threads of the housing and the adjustment ring and rotation of the adjustment ring relative to the housing varies an elevation of the adjustment ring relative to the housing; and wherein variation of the elevation of the adjustment ring relative to the housing varies an elevation of the adjustable cover relative to the housing.

2. The deck jet system of claim 1, wherein the housing is configured to be installed within a concrete deck.

3. The deck jet system of claim 2, wherein variation of the elevation of the adjustable cover relative to the housing aligns the top surface of the adjustable cover with surrounding surfaces of the concrete deck.

4. The deck jet system of claim 1, wherein the adjustment ring comprises a plurality of protrusions circumferentially formed on and extending from the inner surface of the adjustment ring.

5. The deck jet system of claim 4, wherein the plurality of protrusions provide a gripping surface for rotating the adjustment ring relative to the housing.

6. The deck jet system of claim 4, wherein one of the plurality of protrusions provides a visual marker indicating a rotational position of the adjustment ring relative to the housing.

7. The deck jet system of claim 1, wherein rotation of the adjustment ring relative to the housing incrementally varies the elevation of the adjustment ring relative to the housing.

8. The deck jet system of claim 1, wherein rotation of the adjustment ring relative to the housing incrementally varies the elevation of the adjustment ring relative to the proximal end of the housing.

9. The deck jet system of claim 1, wherein the elevation of the adjustable cover relative to the housing includes (a) a vertical component with a magnitude greater than zero and (b) a horizontal component with a magnitude of at least zero.

10. The deck jet system of claim 1, wherein the elevation of the adjustable cover relative to the housing includes (a) a horizontal component with a magnitude greater than zero and (b) a vertical component.

11. A method of adjusting a deck jet system, comprising:

providing a deck jet system including (i) a housing including an inner surface, an outer surface, a proximal end and a distal end, the inner surface of the housing including threads formed thereon, (ii) an adjustment ring including an inner surface, an outer surface, and a top surface, the outer surface of the adjustment ring including threads complementary to the threads of the housing, and (iii) an adjustable cover including a top surface and a bottom surface;

engaging the threads of the housing and the adjustment ring;

rotating the adjustment ring relative to the housing to vary an elevation of the adjustment ring relative to the housing;

inserting the bottom surface of the adjustable cover into the proximal end of the housing with the bottom surface of the adjustable cover being supported by the top surface of the adjustment ring;

wherein variation of the elevation of the adjustment ring relative to the housing varies an elevation of the adjustable cover relative to the housing.

12. The method of claim 10, comprising installing the housing within a concrete deck.

13. The method of claim 12, comprising varying the elevation of the adjustable cover relative to the housing by rotating the adjustment ring relative to the housing to align the top surface of the adjustable cover with surrounding surfaces of the concrete deck.

* * * * *